United States Patent [19]

Bischkopf

[11] 3,975,931

[45] Aug. 24, 1976

[54] FLUSH-IN DEVICE FOR AN APPLIANCE SUCH AS A LAUNDRY OR DISHWASHING MACHINE

[75] Inventor: Hermann Bischkopf, Berlin, Germany

[73] Assignee: Siemens Electrogerate GmbH, Munich, Germany

[22] Filed: Apr. 14, 1975

[21] Appl. No.: 567,943

Related U.S. Application Data

[63] Continuation of Ser. No. 407,152, Oct. 17, 1973, abandoned.

[30] Foreign Application Priority Data

Oct. 26, 1972 Germany ..... 2253094

[52] U.S. Cl. ..... 68/17 R; 134/93; 222/132; 222/193

[51] Int. Cl.[2] ..... D06F 39/02

[58] Field of Search ..... 68/17 R, 207; 134/93; 222/193, 132, 133

[56] References Cited

UNITED STATES PATENTS

| | | | |
|---|---|---|---|
| 3,589,150 | 6/1971 | Poletiek et al. | 68/17 R |
| 3,696,970 | 10/1972 | Bunnell et al. | 68/17 R X |
| 3,760,612 | 9/1973 | Bochan et al. | 134/93 X |

FOREIGN PATENTS OR APPLICATIONS

| | | | |
|---|---|---|---|
| 1,909,698 | 2/1969 | Germany | 68/17 R |
| 1,231,184 | 5/1971 | United Kingdom | 68/17 R |

*Primary Examiner*—Philip R. Coe

*Attorney, Agent, or Firm*—Kenyon & Kenyon Reilly Carr & Chapin

[57] ABSTRACT

A flush-in device for accommodating agents for washing or rinsing can be used in an appliance such as a washing machine, dishwasher and the like equipped with a vessel for washing or rinsing. The flush-in device includes a plurality of chambers arranged one adjacent the other for receiving different agents therein. An outlet structure common to all of the chambers is provided and leads to the above-mentioned vessel. A plurality of water inlet stubs corresponding to respective ones of the chambers are disposed at one location of the flush-in device and a plurality of channel-like water conduits connect respective ones of the stubs to corresponding ones of the chambers.

3 Claims, 4 Drawing Figures

FLUSH-IN DEVICE FOR AN APPLIANCE SUCH AS A LAUNDRY OR DISHWASHING MACHINE

This is a continuation of application Ser. No. 407,152, filed Oct. 17, 1973, now abandoned.

BACKGROUND OF THE INVENTION

The invention relates to a laundry or dishwashing machine with a flush-in device for washing or rinsing agents. The device has chambers arranged side-by-side, one behind the other, or one on top of the other and a common outlet leading to the washing or rinsing vessel. In this connection, reference may be had to Deutsche Gebrauchsmusterschrift No. 1,912,923 and Deutsche Gebrauchsmusterschrift No. 1,939,120.

Modern laundry washing machines or dishwashing machines are almost always equipped with a programmed control unit which makes the automatic timing of the entire laundering or dishwashing process possible. Automatic control necessitates that the washing or rinsing agents are fed in automatically at very definite times during a running program. Most laundering or dishwashing programs require the addition of different agents for washing, rinsing, and soak rinsing or final rinsing. The flush-in devices of these machines are therefore constructed as multi-chamber systems with a common outlet connection and a common connecting line to the washing or rinsing vessel. The water, however, is fed in via separate lines.

So that the feed lines need not be brought to different points of this device, as is the case in the flush-in device described in Deutsch Offenlegungsschrift No. 1,585,808, several solutions have been suggested. Deutsche Gebrauchsmusterschrift No. 6,810,470 discloses the interposition of a swivelled funnel which can be operated by the programmed control unit and by means of which the flush-in jet can be directed in the direction of the chamber that is required at the moment.

In the arrangement according to the Deutsche Auslegeschrift No. 1,247,257, a control element is used which can be similarly operated by the programmed control unit and directs the flush-in water into the chamber required by the program.

The devices mentioned above required only one solenoid valve for all lines by interposing a mechanical joint arrangement. Because such mechanically operated deflection devices are relatively trouble-prone, a solenoid valve is provided in each feed line in many known machines of this kind.

SUMMARY OF THE INVENTION

It is an object of the invention to provide a flush-in device for an appliance such as a washing machine, dishwasher and the like which overcomes the disadvantages of the above-mentioned devices.

It is another object of the invention to provide a water-feed arrangement for the above-mentioned flush-in devices for accommodating the agents for washing or rinsing such that all inlet studs together with their solenoid can be arranged for facilitating assembly even when the chambers of the flush-in device are disposed so as to be separate from one another.

The flush-in device of the invention is suitable for use with an appliance such as a washing machine, dishwasher, and the like equipped with a vessel for washing or rinsing. The flush-in device accommodates agents for washing or rinsing and includes as a feature a plurality of chambers arranged one adjacent the other for receiving different agents therein. An outlet structure common to all of the chambers leads to the above-mentioned vessel. A plurality of water inlet stubs corresponding to respective ones of the chambers are provided and are disposed at one location of the flush-in device. A plurality of channel-like water guides connects respective ones of the stubs to corresponding ones of the chambers.

In this manner a flush-in device for the washing and rinsing agents is obtained wherein the chambers, which are relatively far apart for space reasons, can be supplied by feed lines having inlet connections that can be combined together with their solenoid valve in one block. Such an arrangement substantially simplifies the mechanical and electrical assembly. The channellike water guide always provides that the feed water is always led to the chamber included in the program.

According to a preferred embodiment of the invention, the channel-like water guides are configured as a single structural unit. An embodiment particularly advantageous for production is obtained if the common part is configured so that it can be plugged into the body of the flush-in device which includes all chambers.

Although the invention is illustrated and described herein as a flush-in device for an appliance such as a laundry or dishwashing machine, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENT OF THE INVENTION

Figure 1:
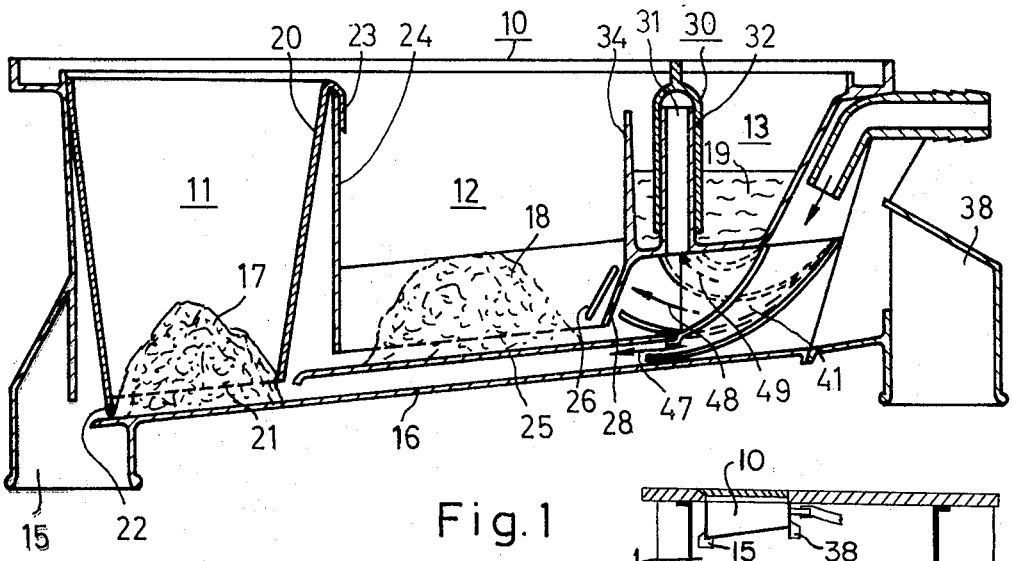
FIG. 1 is a schematic diagram, in section, of the flush-in device.
Figure 1A:
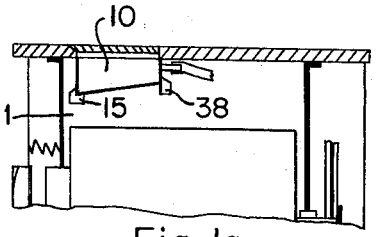
FIG. 1a is a partial, schematic diagram, in section, of a washing vessel for a laundry or dish washing machine including a flush-in device constructed according to the invention.
Figure 2:
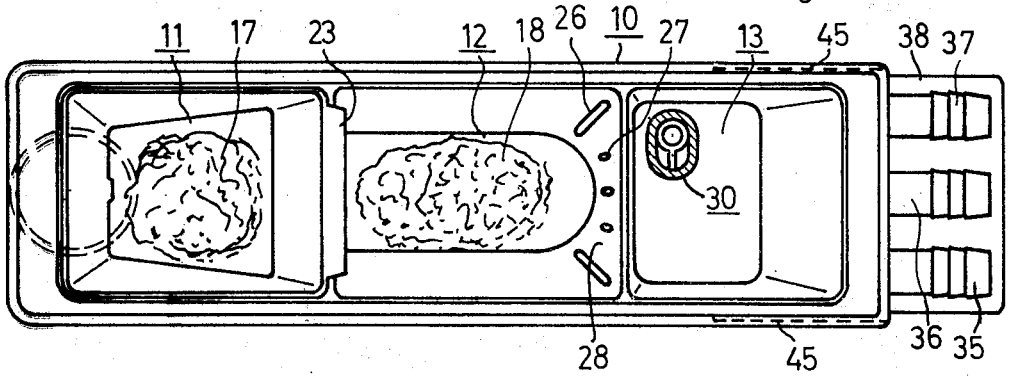
FIG. 2 is a plane view of the flush-in device shown in FIG. 1.

The washing agent flush-in device 10 has three chambers 11, 12 and 13 arranged one behind the other in the direction of the flush-in water. The soaking agent 17 is located in the chamber 11, which is nearest to the common outlet 15 leading to the laundering vessel 1 (FIG. 1a). The chamber 11 is formed by the funnel-shaped insert 20 and the bottom 16 of the device 10, while the chamber 12 is provided for the final washing agent 18. The chamber 13 receives a liquid softener 19.

For flushing in the soaking agent 17, the water is led within the device 10 along the bottom 16 where it flows under the lower edge 21 of the funnel insert 20 and laterally around the soaking agent 17 through the outlet 15 to the laundering vessel 1. In the flow direction the funnel insert is supported only by a post 22 at the bottom 16, while on the opposite side, it engages over the partition 24 of the flush-in device with a bent-over extension 23.

For flushing in the main washing agent 18, the water flows along the intermediate bottom 25 and through the slots 26 and the holes 27 in the conically-shaped chamber wall 28. The water gets to the chamber 13 through the syphon 30. Here, it rises from below through the pipe 31 and arrives, descending through the outer oval pipe 32, at the bottom of the chamber 13. The softener is diluted by the entering water and is conducted over the partition 34 into the chamber 12, which has in the meantime been emptied, and from there to the outlet 15. After the softener is completely flushed in, the chamber 13, filled with flush-in water, is emptied by the fact that the telescoped tubes 31, 32 now act as a syphon and lifts the water out of the chamber in a direction opposite to the flush-in direction.

An inlet connection stub 35 to 37 is provided for each chamber to feed in the water; solenoid valves, not shown, are associated with corresponding ones of the inlet connections. Underneath the inlet connections, which are arranged close together for ease in assembly, there is an overflow 38 from which the water can be led off from the machine in the event of clogging. At the same time, the overflow constitutes a venting point, so that the water coming from the inlet connection can pass through a free section of air.

Figure 3:
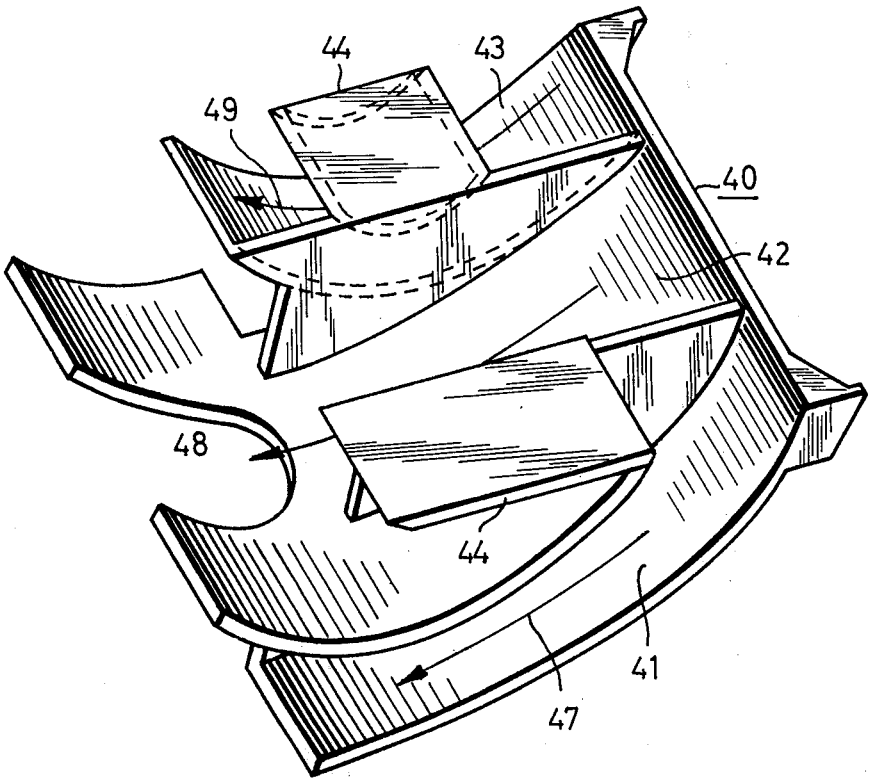
FIG. 3 is a perspective view of the channel-like water guides of the flush-in device of FIG. 1. The water guides are shown here configured to constitute a single structural unit.

The water coming out of the inlet connection is fed to the individual chambers 11 to 13 via duct-like water guides 41 to 43 respectively (FIG. 3, arrows 47 to 49). These water guides are combined in a structural part 40. The part 40 is constructed so that it can be inserted into the flush-in device and for this purpose is provided with rail-like portions 44 which are guided in corresponding slots 45 of the device 10.

For flushing-in, the water coming from the inlet connection 35 is conducted through the duct-like guide 41 along the bottom 16 to the chamber 11 and the soaking agent 17 located therein. The intermediate bottom 25 screens the main washing agent located in the chamber 12 from contact with this flush-in water. For flushing in the final washing agent, the water coming from the feed-in connection 36 is led through the duct-like guide 42 to the inclined wall 28 of the chamber 12. This wall distributes the water to the left and right of the final washing agent 18. Part of the flush-in water can pass through the slots 26 or holes 27 and flush the inclined walls of the chamber 12 clean. The flush-in water coming from the connection 37 is fed to the syphon 30 via the duct-like guide 43 and through it, to the chamber 13 in the manner already described.

What is claimed is:

1. In a laundry or dish washing machine, including a vessel for washing and a flush-in device for washing and cleansing agents, said device having a plurality of water inlet stubs for admitting water to said device, a plurality of chambers disposed one adjacent the other for receiving different ones of said agents therein, and an outlet structure common to all of said chambers and leading to said vessel, the improvement comprising said chambers comprising a unitary structure, with said water inlet stubs and said outlet structure being disposed at opposite ends of said device, and a single component part water guide comprising a plurality of channel-like water ducts for guiding water from respective ones of said inlet stubs to corresponding ones of said chambers, a first one of said chambers including a syphon coupled to one of said water ducts for admitting water thereinto for containing a liquid cleansing agent, a second one of said chambers being disposed adjacent said first chamber and coupled directly to another one of said water ducts for containing a main washing agent, and a third one of said chambers being disposed adjacent said second chamber for containing a soaking agent and being coupled directly to a third one of said water ducts into which water duct an outlet opens from said second chamber, said ducts of said water guide guiding water from said inlet stubs through said syphon into said first chamber, directly into said second chamber from said water inlet stubs, and from said outlet of said second chamber, said chambers being arranged one behind the other in the direction of flow of the water from said inlet stubs and causing the water admitted to said chambers by said water guide to flow in cascade fashion from said first chamber to said third chamber and into said common outlet structure of said flush-in device.

2. The flush-in device of claim 1, said flush-in device further comprising mounting means for insertably mounting said water guide in said unitary structure.

3. The flush-in device of claim 1, said water inlet stubs being mounted at a single location of said unitary structure.

* * * * *